United States Patent [19]

Birocchi

[11] Patent Number: 4,532,412

[45] Date of Patent: Jul. 30, 1985

[54] ELECTRIC STEAM GENERATOR PRODUCING DRY SUPERHEATED STEAM FOR DOMESTIC USE

[76] Inventor: Guido Birocchi, 74, Via Pier della Francesca, Milan, Italy

[21] Appl. No.: 506,667

[22] Filed: Jun. 22, 1983

[30] Foreign Application Priority Data

Jun. 24, 1982 [IT] Italy ..... 22053 A/82

[51] Int. Cl.[3] ..... F22B 1/28; F22B 27/00; F22B 37/26; H05B 3/02

[52] U.S. Cl. ..... 219/271; 38/77.83; 38/77.9; 122/41; 219/273; 219/275; 219/302; 219/305; 239/136

[58] Field of Search ..... 219/296–299, 219/302–305, 308, 309, 271, 276; 239/133, 135, 136; 122/41; 38/77.7–77.9

[56] References Cited

U.S. PATENT DOCUMENTS

| | | | |
|---|---|---|---|
| 1,985,546 | 12/1934 | Nosarzewski | 219/305 X |
| 2,010,331 | 8/1935 | Starrick | 219/298 X |
| 2,039,892 | 5/1936 | Dowinsky | 219/275 X |
| 2,059,620 | 11/1936 | Abrams et al. | 38/77.6 |
| 2,145,287 | 1/1939 | Beyrodt | 219/302 X |
| 2,258,746 | 10/1941 | Dickman | 219/273 X |
| 2,294,578 | 9/1942 | Shapiro et al. | 219/297 X |
| 2,606,272 | 8/1952 | Platt | 219/273 |
| 3,410,986 | 11/1968 | Groom | 219/273 X |
| 3,419,666 | 12/1968 | Groom | 219/273 X |
| 4,255,646 | 3/1981 | Dragoy et al. | 219/302 X |

FOREIGN PATENT DOCUMENTS

| | | | |
|---|---|---|---|
| 1113576 | 12/1955 | France | 219/273 |
| 2067600 | 7/1981 | United Kingdom | 38/77.83 |

*Primary Examiner*—A. Bartis

*Attorney, Agent, or Firm*—Stevens, Davis, Miller & Mosher

[57] ABSTRACT

An electric steam generator for generating superheated steam for domestic use includes a cylindrical body provided with a plurality of sector-shaped vaporization chambers closed at their top by a removable plate defining at its central region a first superheating chamber. An inverted cup-shaped body closed at its top by a plate and having a lateral wall defines, together with the removable plate, a second superheating chamber surrounding the first superheating chamber. The body is provided with an electric resistance heater for heating the vaporization and superheating chambers to operating temperature. Water is pumped into the vaporization chambers where it is instantaneously vaporized to steam which flows therefrom in series through the first and second superheating chambers to a steam delivery duct. The vaporization chambers and superheating chambers are connected by ducts of reduced diameter to subject the flowing steam alternately to acceleration in the ducts and to expansion in the chambers thereby assuring complete vaporization of the water and delivery of dry superheated steam.

5 Claims, 4 Drawing Figures

ELECTRIC STEAM GENERATOR PRODUCING DRY SUPERHEATED STEAM FOR DOMESTIC USE

The present invention relates to a steam generator for domestic use, particularly but not exclusively for irons.

It is known that the domestic steam generators currently available are essentially small-scale boilers, in which water is heated by appropriate electrical resistances.

The technical disadvantages of steam generators of the above-mentioned type arise from:

(a) the need to provide the boiler body with an elaborate and complex structure and to allow for the use of temperature and pressure control and regulation devices to meet the safety regulations governing, for example, and in particular, the occasions when water is added to the boiler during operation of latter;

(b) the necessity of always heating all of the water in the boiler, even for a small steam requirement, and (c) the need to use high-power electrical resistances with a high consumption of electricity, in order to reduce the heating time for the water in the boiler.

The problem behind the present invention is the provision of a steam generator for domestic use having stuctural and functional characteristics such as to overcome the disadvantages mentioned above with reference to the prior art.

This problem is solved according to the invention by a steam generator including a generator body with a source of heat and charcterised in that it further includes at least one water vaporisation chamber formed in the body, a water inlet duct to the vaporisation chamber, non-return valve means in the inlet duct, at least one steam superheating chamber in communication with said least one vaporisation chamber through a duct of reduced cross-section, and a steam delivery duct from the superheating chamber.

In a preferred embodiment, the steam generator also includes a water reservoir which is structurally independent from the generator body, and a water supply pump having an intake pipe in communication with the reservoir and a delivery pipe in communication with the inlet duct to the vaporisation chamber.

One embodiment of the steam generator according to the invention, will now be described, by way of example, with reference to the attached drawings, in which.

Figure 2:
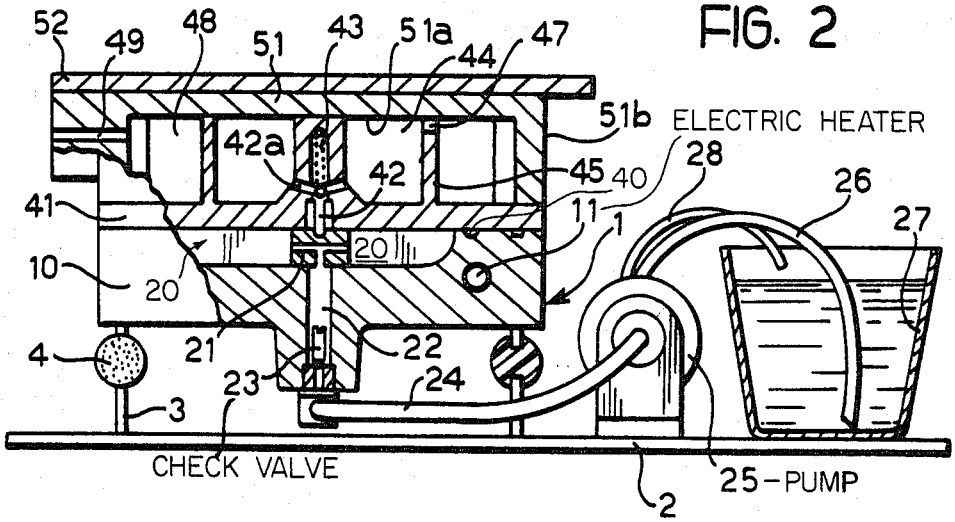
FIG. 2 is a partially-sectioned side elevational view of the steam generator of FIG. 1.
Figure 4:
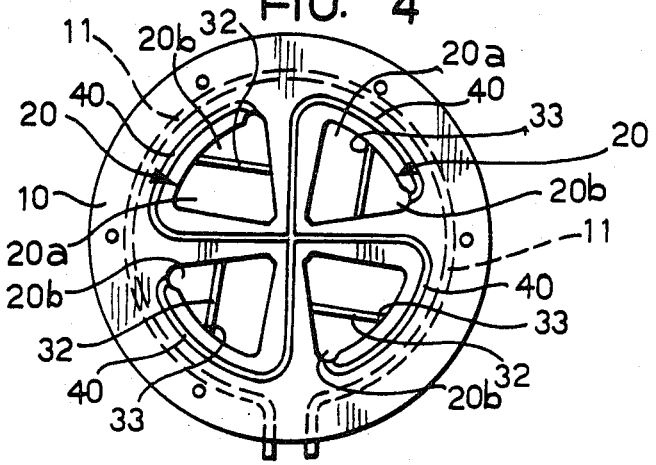
FIG. 4 is a plan view of a detail of the steam generator body of FIG. 3.
Figure 1:
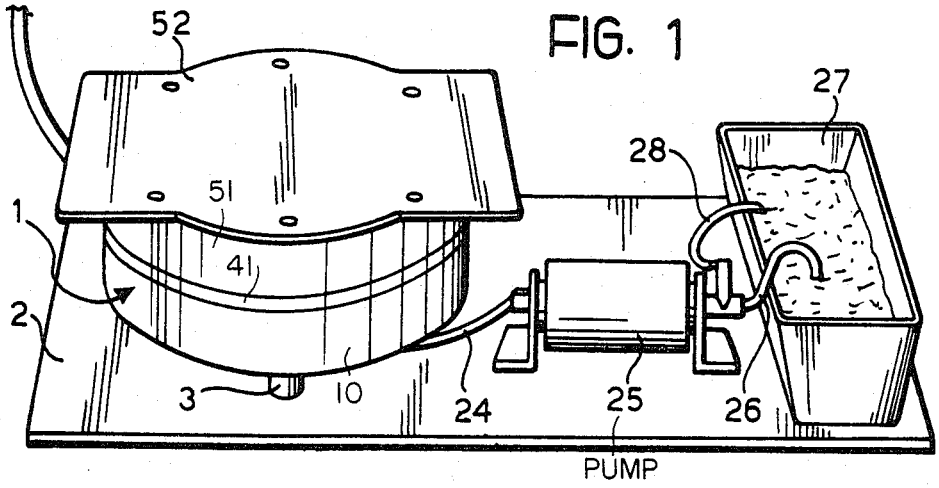
FIG. 1 is a general perspective view of a steam generator for domestic use according to the invention.
Figure 3:
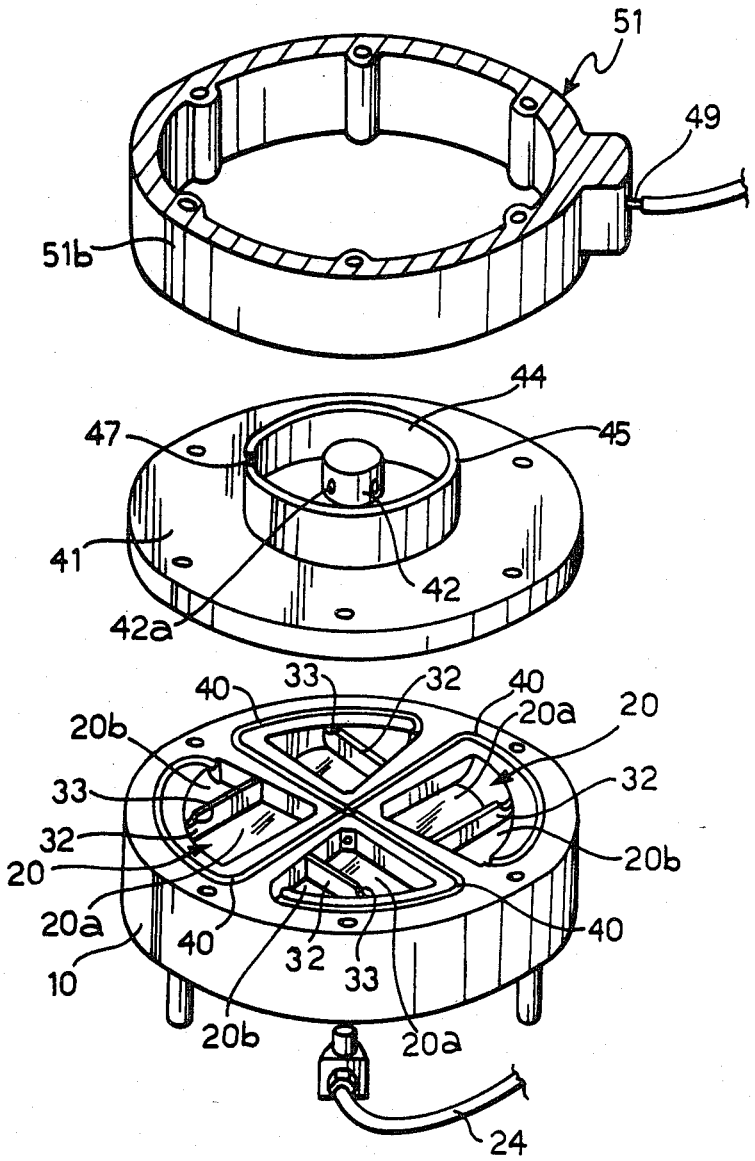
FIG. 3 is a partially-sectioned, exploded perspective view of the body of the steam generator of FIG. 1.

With reference to the drawings, a steam generator for domestic use comprises a cylindrical body 1 which is mounted on a baseplate 2 by means of feet 3 including interposed blocks 4 of a thermally-insulating material, such as Bakelite.

The body 1 includes a base 10 incorporating a sheathed electric heater 11 as a source of heat. Four sector-shaped vaporisation chambers 20 are formed in the base 10, being arranged in diametrically opposed pairs. Each of the vaporisation chambers 20 is divided into two contiguous portions 20*a*, 20*b* by a division wall 32 provided with a restricted through port 33.

The portion 20*a* of the vaporisation chambers 20 communicate with a water inlet duct 22 through a four-way distributor 21 formed centrally of the base 10. A check valve, schematically indicated 23, is located in the duct 22.

In this preferred embodiment, the vaporisation chambers 20 are open upwardly and are closed from above by a removable plate 41 which can be removably secured to the base 10 of the generator body 1 in a pressure-tight manner. The plate 41 is provided in its central region with a circular wall 45 which extends coaxially from that side of the plate opposite the base 10. This wall 45 delimits a steam superheating chamber 44 which is closed from above by the bottom 51*a* of an inverted cup-shaped body 51 fixed coaxially on the plate 41 in a pressure-tight manner. The lateral wall 51*b* of the inverted cup-shaped body 51 surrounds coaxially the circular wall 45 of the plate 41, with which it delimits a further steam superheating chamber 48. This chamber 48 communicates with the chamber 44 through a passage 47 of reduced cross-section formed in the aforesaid circular wall 45.

A plurality of ducts 40 formed in the base 10 of the generator body 1 put the portions 20*b* of the vaporisation chambers 20 into communication with distributor 42 formed centrally in the plate 41. The distributor communicates, in turn, with the superheating chamber 44 through a plurality of passages 42*a*.

The superheating chamber 48 communicates with the exterior of the generator body 1 through a steam delivery duct 49. Advantageously, the steam delivery duct 49 extends from a position diametrically opposite the communicating passage 47 between the superheating chambers 48, 44.

A pump 25 has its delivery pipe 24 connected to the water inlet duct 22, while its intake pipe 26 draws from a water reservoir 27 which is structurally independent of the generator body 1. a regulating pipe 28 of the pump 25 open over the reservoir 27.

The steam generator of the invention is completed by a bearing plate 52 fixed on the generator body 1 and intended to constitute, for example, a support for an iron.

The steam generator of the invention operates as follows.

By means of the pump 25, which is operated directly by the user for a longer or shorter time depending on the quantity of steam to be used, water from the reservoir 27 is introduced into the portion 20*a* of the vaporisation chambers 20 where it vaporises instantaneously. The steam thus generated, and any incompletely vaporised water drawn by the steam, passes into the portion 20*b* of the vaporisation chambers 20 through the ports 33 of reduced cross-section. The steam (and any water drawn thereby) passes through the restricted ports 33 at a significant velocity and expands immediately afterwards (thus slowing) in the portions 20*b* of the vaporisation chambers 20. As a consequence, any water drawn in with the steam is completely vaporised, and a simultaneous further heating of the steam is effected. Subsequently, the steam passes through the plurality of ducts 40 (which are heated) to the first superheating chamber 44 and, from this, through the passage 47 into the second superheating chamber 48. It should be noted that, during transit, the steam is subjected alternately to acceleration (in the ducts 40 and the restricted passage 47)

and to expansion (in the chambers 44, 48 which are particularly heated). The result of this alternating action within the hot environment of the generator body 1 is that jets of practically dry steam of significant intensity, that is, free from even traces of water, can be obtained from the steam generator of the present invention.

As well as this indisputable technical advantage, a further advantage is constituted by the fact that the water reservoir is structurally independent from the generator body 1 so that there are none of the safety problems attendant upon the boilers of the prior art.

I claim:

1. A steam generator for domestic use, of the type provided with an electric heater and including:

a generator cylindrical body provided with a plurality of upwardly open sector-shaped vaporization chambers each including a water inlet and a steam outlet;

a removable plate closing the top of said upwardly open vaporization chambers and defining a first superheating chamber having a steam inlet in communication with the steam outlets of said vaporization chambers and a superheated steam outlet;

an inverted cup-shaped body closed at its top by a plate and having a lateral wall defining, together with said removable plate, a second superheating chamber having an inlet communicating with the outlet of the first superheating chamber and a superheated steam delivery outlet;

an electric heater associated with the cylindrical body for heating the vaporization chambers and the superheating chambers to operative temperature.

2. A steam generator as defined in claim 1, wherein said generator body includes said vaporization chambers arranged in diametrically opposed pairs, each of said vaporization chambers being divided into two contiguous portions provided with a restricted through port therebetween.

3. A steam generator as defined in claim 1, wherein said removable plate is provided in its central region, with a circular wall which extends coaxially from the side of the plate opposite the generator body and defines with said cup-shaped body said first superheating chamber.

4. A steam generator as defined in claim 3, wherein said inverted cup-shaped body is fixed coaxially on said removable plate, the lateral wall of said inverted cup-shaped body surrounding coaxially said circular wall of said removable plate and defining said second superheating chamber.

5. A steam generator as defined in claim 1, wherein the superheated steam delivery outlet of the second superheating chamber is formed by a steam delivery duct extending from a position diametrically opposite a passage forming the communication between the first superheating chamber and the second superheating chamber.

* * * * *